United States Patent [19]

Hoyt

[11] 4,149,482

[45] Apr. 17, 1979

[54] AERODYNAMIC MAINSAIL AND FURLING DEVICE

[76] Inventor: John G. Hoyt, 15 Almendro, Santurce, P.R. 00913

[21] Appl. No.: 841,912

[22] Filed: Oct. 13, 1977

[51] Int. Cl.[2] ..... B63H 9/10

[52] U.S. Cl. ..... 114/106; 114/39; 114/90

[58] Field of Search ..... 114/102, 103, 104–107, 114/39, 90, 91, 97

[56] References Cited

U.S. PATENT DOCUMENTS

| | | | |
|---|---|---|---|
| 1,613,890 | 1/1927 | Herreshoff | 114/90 X |
| 1,700,660 | 1/1929 | Williams | 114/90 X |
| 2,077,685 | 4/1937 | Gerhardt | 114/103 |
| 2,107,303 | 2/1938 | Ljungstrom | 114/106 |
| 2,561,253 | 7/1951 | Wells-Coates | 114/102 |
| 3,381,647 | 5/1968 | Keeler | 114/102 |
| 3,487,800 | 1/1970 | Schweitzer et al. | 114/39 |
| 3,720,180 | 3/1973 | Stangeland | 114/102 |
| 3,749,042 | 7/1973 | Jackson | 114/106 |
| 3,835,804 | 9/1974 | Jackson | 114/107 |

FOREIGN PATENT DOCUMENTS

| | | | |
|---|---|---|---|
| 408424 | 10/1967 | Australia | 114/103 |
| 838999 | 4/1970 | Canada | 114/103 |

*Primary Examiner*—Charles E. Frankfort
*Assistant Examiner*—Sherman D. Basinger
*Attorney, Agent, or Firm*—Barlow & Barlow

[57] ABSTRACT

A sleeve is rotatably mounted on the hull of a vessel on a generally vertical axis and contains and completely supports the mainsail rollably furled or partly furled about a generally vertical axis. The sleeve is aerodynamically formed with a forward curved nose and opposite aerodynamic sides extending rearwardly from the nose and converging toward each other with a slot at the aft end between the sides through which slot a sail may be movable to furl within the sleeve or may be pulled out at the aft end of the sleeve through the slot various extents for providing the desired area of sail exposed to the wind, thus providing a roller reefing arrangement by rolling the luff of the mainsail to partly furl it within the sleeve.

4 Claims, 5 Drawing Figures

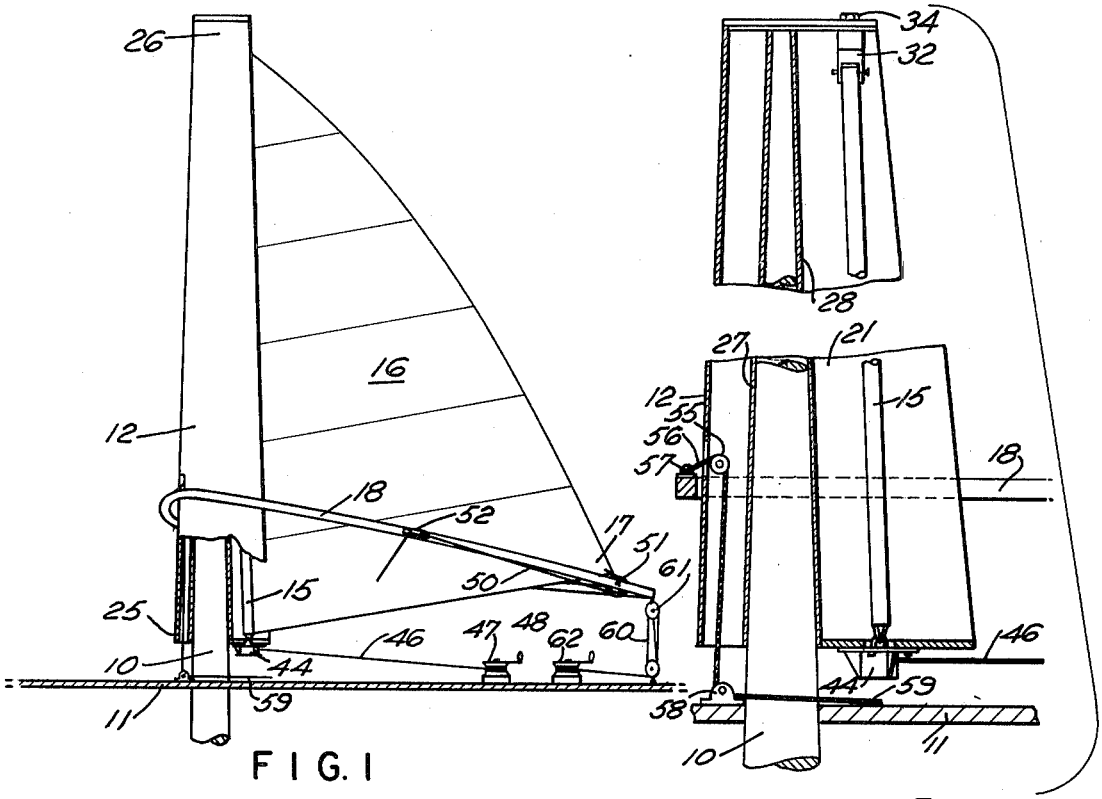
FIG. 1
FIG. 3
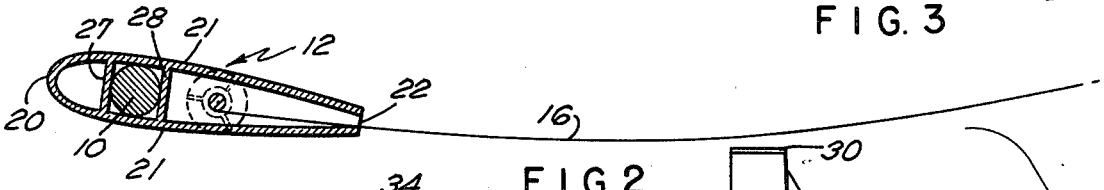
FIG. 2
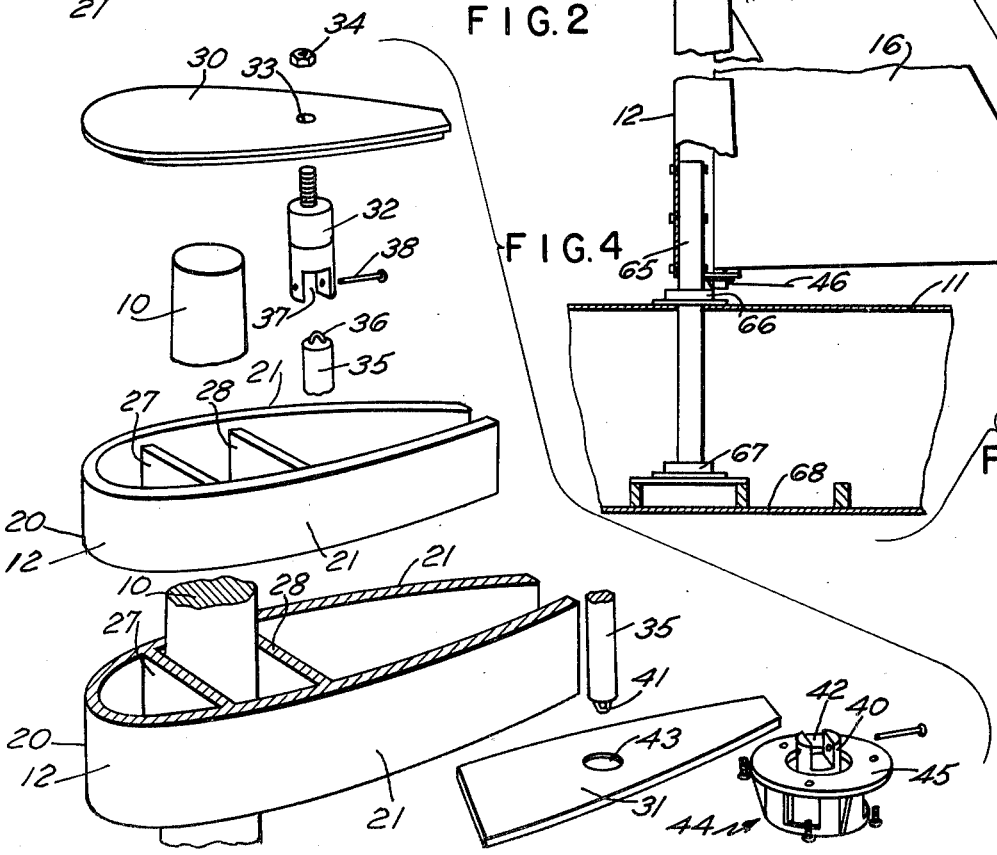
FIG. 4
FIG. 5

AERODYNAMIC MAINSAIL AND FURLING DEVICE

BACKGROUND OF THE INVENTION

Various means have been attempted to provide an air foil for the mainsail of a sailing vessel such as the wrapping of a sail about the mast so that there will be a smooth curved aerodynamic lee side of the sail to prevent disrupting wind eddies at the mast where the sail is all in one smooth section from the mast to its leech as in U.S. Pat. Nos. 2,077,685 or 2,107,303 or by sections added to the mast as in U.S. Pat. No. 2,561,253. In U.S. Pat. No. 2,561,253 generally horizontal battens are utilized to shape the mainsail and this is also shown in U.S. Pat. No. 3,381,647. As for the furling, sails have been furled on a vertical axis within a fixed mast and aft of a fixed mast, without the provision of the aerodynamic means just referred to, such as in U.S. Pat. Nos. 3,749,042; 3,835,804. The sail in U.S. Pat. No. 2,107,303 is wrapped about the outside of the mast by rotating the mast.

SUMMARY OF THE INVENTION

A free standing unstayed sleeve is rotatably mounted with a substantially vertical axis on a vessel and has a forward curved nose and opposite aerodynamically shaped sides extending rearwardly from the nose and converging toward each other with a slot between them at the aft end of the sleeve. A roller furling means is mounted on a vertical axis by and within the sleeve to bodily rotate with the sleeve while the sail, which is wound about this furling means for furling, may be moved in and out through the slot in the sleeve at its aft end for varying the area of the sail exposed to the wind and thus provide a means by such furling to reef the sail while in no way disturbing the aerodynamic sides of the sleeve which provide for the forward thrust of the boat upon which the sail is effective.

DESCRIPTION OF THE DRAWINGS

FIG. 1 is a fragmental elevation partly in section showing a mast with a sleeve associated therewith and a sail with its luff within the sleeve;

FIG. 2 is a horizontal sectional view, somewhat diagrammatic, of the mast and sleeve with the sail extending therefrom;

FIG. 3 is a fragmental vertical sectional view of the mast and sleeve and the furling mechanism within the sleeve omitting the sail;

FIG. 4 is an exploded view showing various sections of the mast and sleeve and the mounting plates and mechanisms assembled therewith;

FIG. 5 is an elevation partly in section of a modified rotatable sleeve mounting.

DESCRIPTION OF THE PREFERRED EMBODIMENT

In FIG. 1 a mast 10 is shown extending upwardly from the deck 11 of a sail vessel and which has a sleeve 12, the dominant feature of this invention, rotatably embracing the mast 10. The sleeve houses and completely mounts a roller furling mechanism 15 for a sail 16. The luff of sail 16 is shown associated with the roller furling mechanism within the sleeve with the sail extending through a slot in the aft end of the sleeve, while its clew 17 is secured to an outhaul on a wishbone boom 18, the forward end of which is adjustably vertically mounted on the sleeve 12.

The mast 10 in FIG. 1 is a free standing mast with no stays to support it, it being sufficiently strong to be mounted without any support. The mast 10 extends upwardly from the deck 11 a desired height depending upon the size of the boat with which it is used. A sleeve 12 shown better in FIGS. 2 and 4 is of a stiff material, such as Kevlar, although other similar materials may be used, and is shaped as perhaps best shown in FIGS. 2 and 4 where it is provided with a forward nose portion 20 and opposite sheet-like sides 21 which are aerodynamically curved to provide the correct air foil desired for the sail. These sides 21 converge as they extend rearwardly from the nose 20, as shown in FIG. 2, leaving a slot 22 between them at the aft edge. This sleeve extends substantially the entire height of the mast 10 and is tapered somewhat so that it is larger at the lower end 25 than it is at the upper end 26, as shown best in FIG. 1, and it is mounted on the mast for rotation through 360° by means of braces 27 and 28, the brace 27 engaging the forward side of the mast and the brace 28 engaging the aft side of the mast when the sail is close hauled, and these braces are spaced apart about the diameter of the mast and are on either side of it as seen in FIGS. 2 and 4 but are sufficiently loose on the mast so that although they are in guiding-like relation, they do not restrict to any great extent the rotative movement of the sleeve about the mast when the main sheet is slacked for reaching or running. These braces 27 and 28 extend vertically the full length of the sleeve for good support and bracing of the sleeve, although they may be intermittently mounted in spaced relation if desired. These braces may be arched on their faces which engage the mast. The plate 30 is secured to the upper end of the sleeve and rests on the top of mast 10.

A roller furling means for the sail is mounted within the sleeve as shown at 15 in FIGS. 1 and 3 and is rotatably mounted in a top plate 30 at the upper end of the sleeve which rests on the top of the mast 10 and supports the sleeve and a bottom plate 31 secured at the lower end of the sleeve from the brace 28 to the slot 22, both to rotate with the sleeve or move with the sleeve in any of its movements. A swivel 32 extends through a hole 33 in plate 30 as a bearing in the upper plate and is secured there by a nut 34. A flexible rod 35 has a tongue portion 36 which is held in the slot 37 of the swivel 32 such as by a pin 38, while the lower end of this rod 35 attaches to a jaw 40 by means of a clevis pin engaging the tongue portion 41 extending into the slot 42 of the jaw. This jaw 40 extends through the opening 43 in a plate 31 for its operation and is housed in a cage 44 with a flange 45 secured to the underside of plate 31 and the jaw 40 is secured to a drum inside the cage upon which a rope or cable 45 may be wrapped for rotating the furling rod 35. This rope or cable is shown at 46 in FIG. 1 as leading from the drum within the cage to a winch 47 which may be operated by handle 48 from the cockpit of the vessel on which this is mounted. The sail 16 is attached to the furling means or flexible rod 35 in a known manner such as by slot and bolt rope so that as the flexible rod 35 is rotated, the sail will be wrapped or rolled about it, which may be done by means of the rope or wire 46 and the winch 47 at any stage of operation to provide the desired sail area exposed to the wind such as may be desired for reefing the sail. To haul the sail outwardly from its rolled or furled position about the rod 15, an outhaul rope 50 attached to the clew 17 will be passed about an outhaul pulley 51 and then led back to some securing cleat 52 along the boom 18.

The boom 18 is mounted by the sleeve 12 by means of a pulley 55 mounted within the sleeve at its forward or nose portion and a rope or line 56 is attached to an eye 57 on the boom and then passed over the pulley 55 and then downwardly about a pulley 58 on the deck and then aft as at 59 to a cleat or winch for securing the same. Thus the forward end of the wishbone boom 18 may be adjusted to height along the sleeve 12. To trim the wishbone boom and mainsail the main sheet 60 is attached to the outer end of the boom and thence through suitable blocks 61 to a winch 62.

As above described the sleeve 12 is rotatably mounted on a fixed mast 10 as one way of rotatably mounting the sleeve. However, in FIG. 5, there is shown a sleeve 12 which is similar to the sleeve 12 above described in that it has the roller furling for the sail mounted upon upper and lower plates as above described. However, instead of mounting the sleeve rotatably on the mast 10 as above described, in FIG. 5, the sleeve 12 is shown as fixed to a cylindrical post or stub mast 65 which is rotatable through 360° with the sleeve 12, the post 65 being mounted in anti-friction bearings 66 secured to deck 11, and an anti-friction bearing 67 secured on the floor 68 of the vessel upon which the rig is mounted. In this case there is no fixed mast but the sleeve is freely selfstanding without any stays and needs no support.

I claim:

1. In a sailboat, a deck, a mast, a sleeve embracing said mast and mounted thereon by means of a plate fixed to the upper end of the sleeve and supported by the upper end of the mast and sleeve braces extending laterally from side to side of the sleeve and extending vertically a substantial length of the sleeve on opposite sides of the mast for bearing engagement with the mast, said sleeve comprising a forward curved nose with opposite aerodynamic sides extending rearwardly from the nose and converging toward each other with a slot between them at the aft end of said sleeve, sail roller furling means rotatably mounted by and within said sleeve and bodily rotatable therewith, and a sail secured to said sail furling means and movable through said slot at the aft end of said sleeve to be rolled upon or unrolled from said sail furling means.

2. In a sailboat as in claim 1 wherein said sleeve braces extend vertically substantially the entire length of the sleeve.

3. In a sailboat as in claim 1 wherein said sleeve has spaced laterally extending plates adjacent its upper and lower ends rotatably mounting said roller furling means.

4. In a sailboat as in claim 3 with means below the lower plate and the sleeve to rotate said sail furling means.

* * * * *